US005347781A

United States Patent [19]

Hanlon

[11] Patent Number: 5,347,781

[45] Date of Patent: Sep. 20, 1994

[54] MASONRY TIE

[76] Inventor: Brian J. Hanlon, 2129 E. Fairmount Ave., Baltimore, Md. 21231

[21] Appl. No.: 55,288

[22] Filed: May 3, 1993

[51] Int. Cl.[5] ..... E04B 1/38

[52] U.S. Cl. ..... 52/379; 52/713

[58] Field of Search ..... 52/378, 379, 357, 359, 52/513, 713, 508, 235

[56] References Cited

U.S. PATENT DOCUMENTS

| | | | |
|---|---|---|---|
| 1,942,863 | 1/1934 | Tohastone | 52/713 |
| 2,413,425 | 12/1946 | Anderson et al. | 52/379 |
| 2,853,870 | 9/1958 | Sinner et al. | 52/378 |
| 3,341,998 | 9/1967 | Lucas | 52/379 |
| 4,473,984 | 10/1984 | Lopez | 52/379 |
| 4,596,102 | 6/1986 | Catani et al. | 52/713 |
| 4,955,172 | 9/1990 | Pierson | 52/379 |
| 4,970,842 | 11/1990 | Kappeler et al. | 52/741 |
| 5,035,099 | 7/1991 | Lapish | 52/713 |
| 5,207,403 | 5/1993 | McGee et al. | 52/239 |

*Primary Examiner*—Carl D. Friedman
*Assistant Examiner*—Winnie Yip
*Attorney, Agent, or Firm*—E. Michael Combs

[57] ABSTRACT

A masonry tie formed of a polymeric rigid construction includes an anchor plate arranged for reception within a mortar joint, with the anchor plate having a cylindrical head that is received within a tubular sleeve, that in turn is orthogonally secured to a second anchor plate, with the second anchor plate having a mounting plate for accommodating a wall board thereon in a spaced orientation relative to the mortar joint and associated mortar blocks.

5 Claims, 4 Drawing Sheets

MASONRY TIE

BACKGROUND OF THE INVENTION

1. Field of the Invention

The field of invention relates to masonry wall support structure, and more particularly pertains to a new and improved masonry tie wherein the same is arranged to provide for support of a wallboard structure in a spaced orientation relative to a masonry wall.

2. Description of the Prior Art

Air barrier structure is available in the prior art as indicated in U.S. Pat. No. 4,970,842, wherein a wall tie structure is indicated in U.S. Pat. No. 5,035,099.

The instant invention attempts to overcome deficiencies of the prior art by employing a polymeric wall tie resistant to erosion and the like formed of a polymeric material oriented to secure and position a wallboard structure in a spaced orientation relative to a masonry wall and in this respect, the present invention substantially fulfills this need.

SUMMARY OF THE INVENTION

In view of the foregoing disadvantages inherent in the known types of wall tie structure now present in the prior art, the present invention provides a masonry tie wherein the same is arranged for securement to a masonry wall positioning a wallboard in a spaced relationship relative to the masonry wall. As such, the general purpose of the present invention, which will be described subsequently in greater detail, is to provide a new and improved masonry tie which has all the advantages of the prior art masonry ties and none of the disadvantages.

To attain this, the present invention provides a masonry tie formed of a polymeric rigid construction including an anchor plate arranged for reception within a mortar joint, with the anchor plate having a cylindrical head that is received within a tubular sleeve, that in turn is orthogonally secured to a second anchor plate, with the second anchor plate having a mounting plate for accommodating a wall board thereon in a spaced orientation relative to the mortar joint and associated mortar blocks.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved masonry tie which has all the advantages of the prior art masonry ties and none of the disadvantages.

It is another object of the present invention to provide a new and improved masonry tie which may be easily and efficiently manufactured and marketed.

It is a further object of the present invention to provide a new and improved masonry tie which is of a durable and reliable construction.

An even further object of the present invention is to provide a new and improved masonry tie which is susceptible of a low cost of manufacture with regard to both materials and labor, and which accordingly is then susceptible of low prices of sale to the consuming public, thereby making such masonry ties economically available to the buying public.

Still yet another object of the present invention is to provide a new and improved masonry tie which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
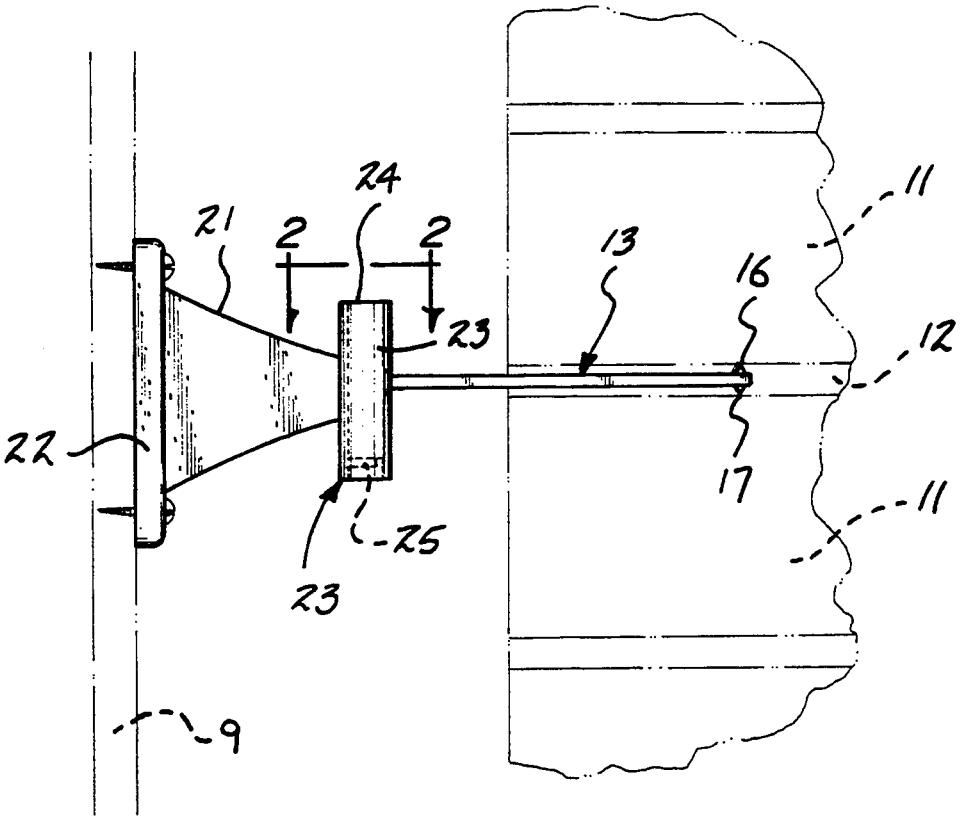
FIG. 1 is an orthographic side view of the invention.
Figure 2:
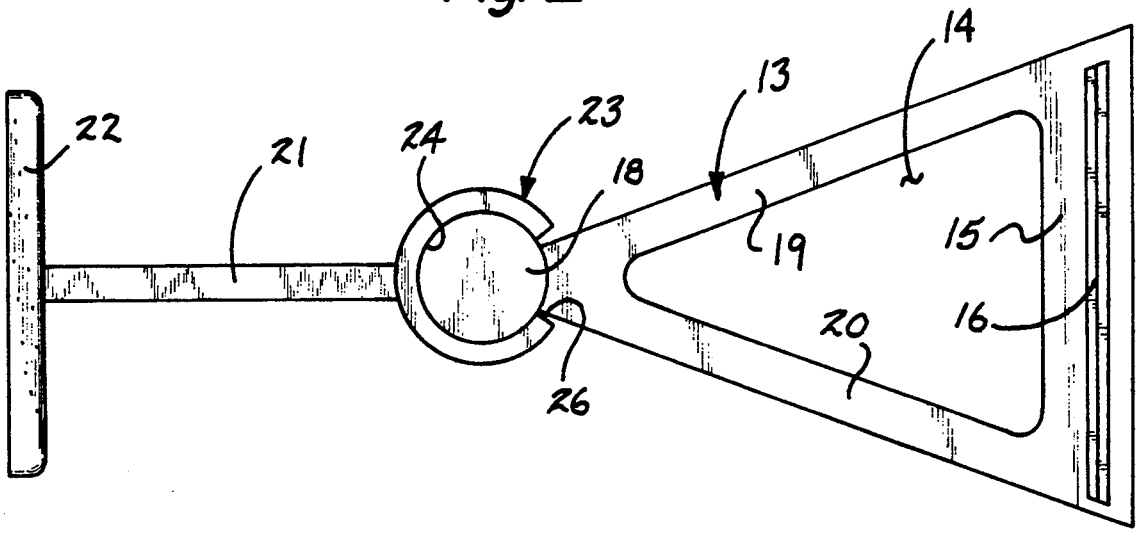
FIG. 2 is an orthographic top view of the invention, taken along the lines 2—2 of FIG. 1 in the direction indicated by the arrows.
Figure 3:
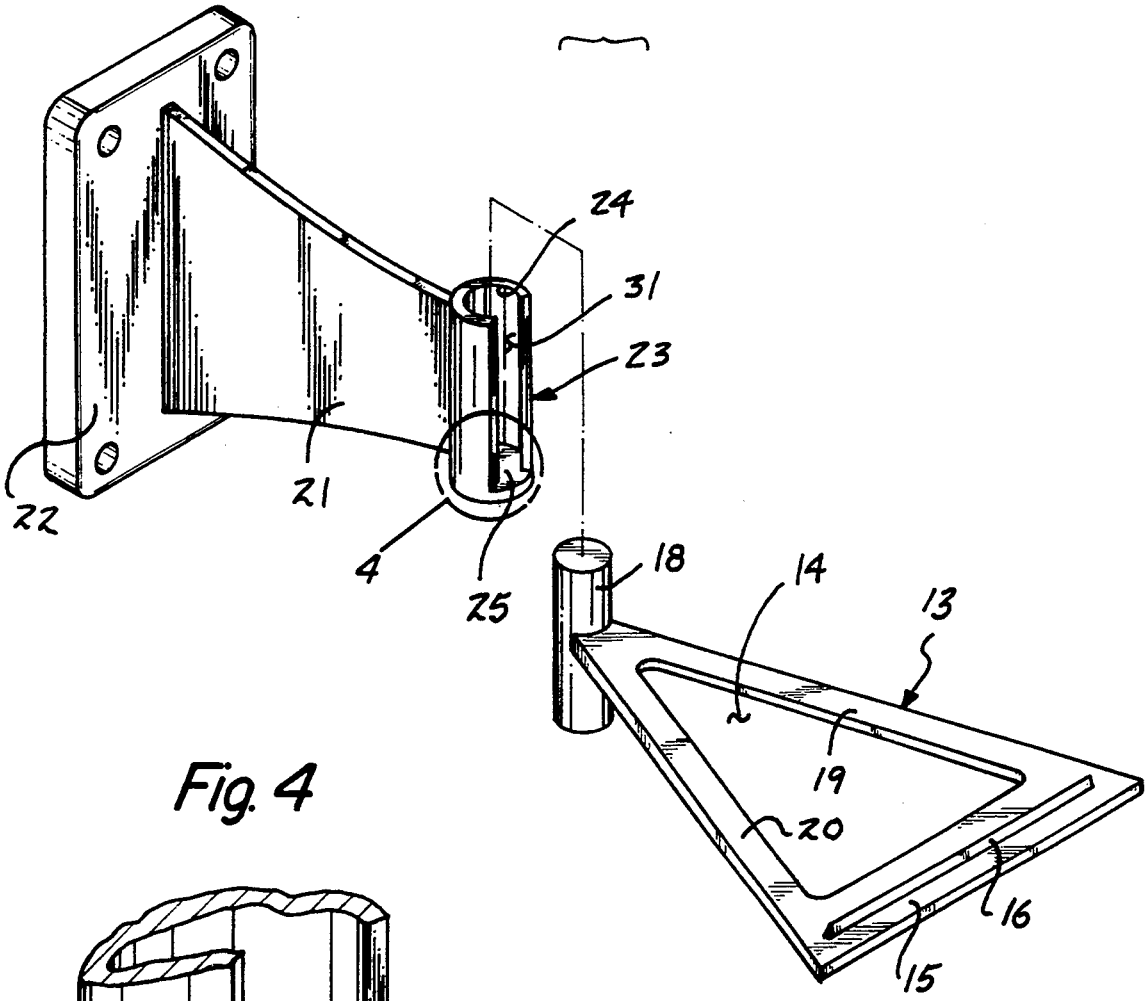
FIG. 3 is an isometric exploded view of the invention.
Figure 4:
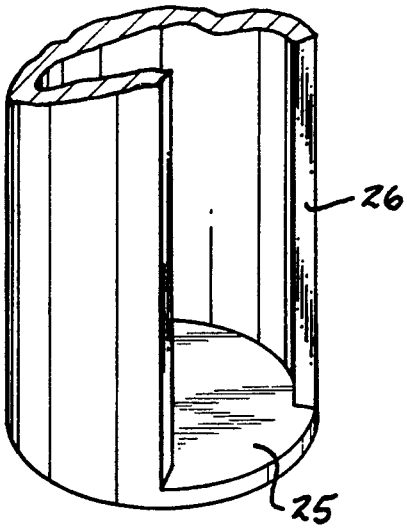
FIG. 4 is an enlarged orthographic view of section 4 as set forth in FIG. 3.

With reference now to the drawings, and in particular to FIGS. 1 to 8 thereof, a new and improved masonry tie embodying the principles and concepts of the present invention and generally designated by the reference numeral 10 will be described.

More specifically, the masonry tie 10 of the instant invention essentially comprises an essentially triangular and planar first anchor plate 13, having a central opening 14 projected therethrough to receive mortar from a mortar joint 12 that is oriented between a plurality of masonry blocks 11 of the masonry wall, as indicated in FIG. 1. The anchor plate 13 includes a base leg 15 and first and second blade members 16 and 17 orthogonally and coextensively mounted to respective first and second sides of the base leg 15 projecting from the base leg, with first and second legs 19 and 20 respectively extending from the base legs at an apex mounting a cylindrical head 18 thereto in a fixed orientation orthogonally oriented relative to the anchor plate 13. A second anchor plate 21 is provided that is employed in an orthogonal orientation relative to the first anchor plate 13, with the second anchor plate 21 having a mounting plate 22 orthogonally and fixedly mounted at a first end of the second anchor plate 21, with a second end of the anchor plate 21 includes a tubular sleeve 23. The tubular sleeve 23 includes a sleeve entrance opening 24 spaced from a sleeve floor 25 defining a sleeve cavity 31 therewithin. The sleeve 23 further includes a side wall opening 26 that extends from the sleeve entrance opening 24 to the floor 25 diametrically opposed to the second anchor plate 21 to receive the cylindrical head 18 therewithin to thereby substantially align the first anchor plate to the second anchor plate, with the first anchor plate substantially bisecting the second anchor plate relative to orientation between the first and second legs 19 and 20. In this manner, fasteners are employed to secure a wallboard 9, as indicated in FIG. 1, to the mounting plate 22.

Figure 5:
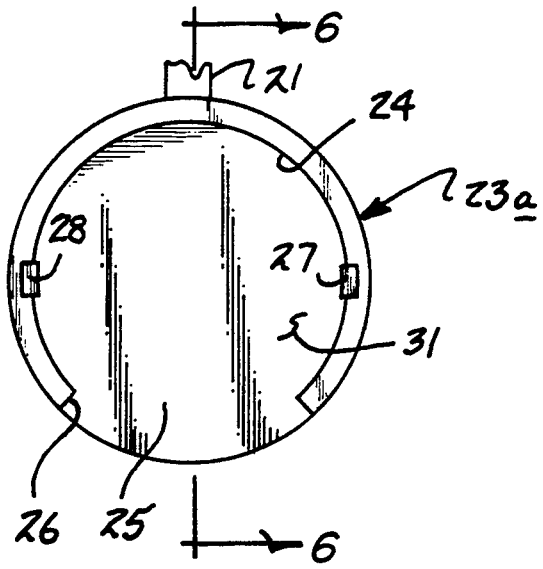
FIG. 5 is an orthographic top view of a modified sleeve structure of the invention.
Figure 6:
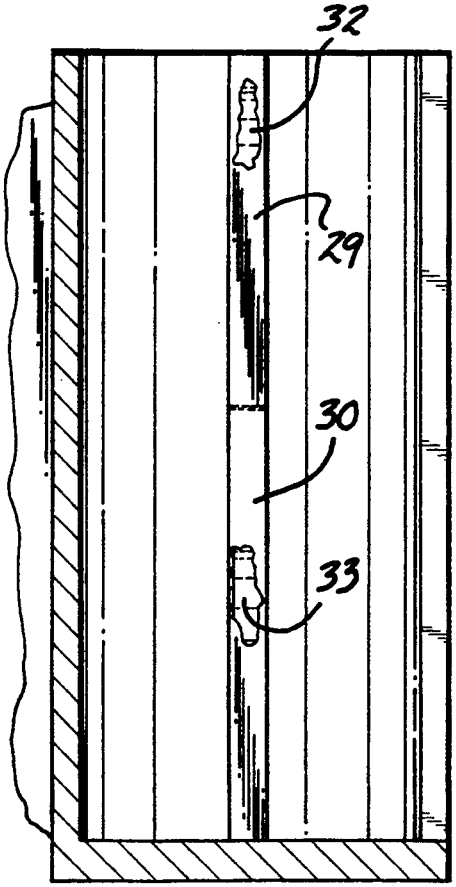
FIG. 6 is an orthographic view, taken along the lines 6—6 of FIG. 5 in the direction indicated by the arrows.

The FIGS. 5 and 6 indicate respective first and second channels 27 and 28 mounted on diametrically opposed sides relative to one another within the sleeve cavity 31 extending from the entrance opening 24 to the floor 25, having respective first and second capsules 29 and 30 within each of the first and second channels 27 and 28. The first capsule 29 includes an epoxy resin 32 therewithin, wherein an epoxy hardener 33 is contained within the second capsule 30, whereupon the first and second capsules 29 and 30 project into the sleeve cavity 31 thereby effecting rupture of the first and second capsules 29 and 30 within each of the first and second channels 27 and 28 when the cylindrical head 18 is directed therein.

Figure 7:
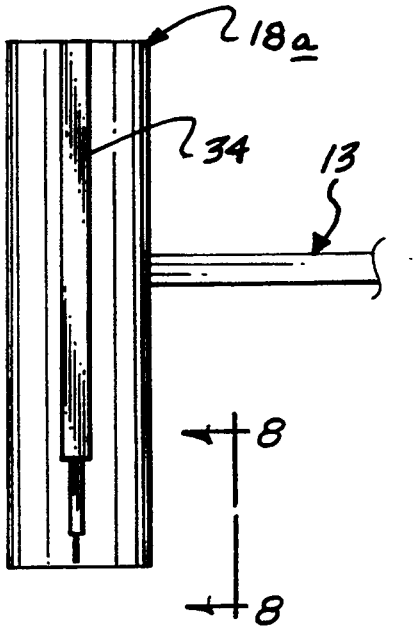
FIG. 7 is an orthographic side view of a modified cylindrical head as employed by the invention.
Figure 8:
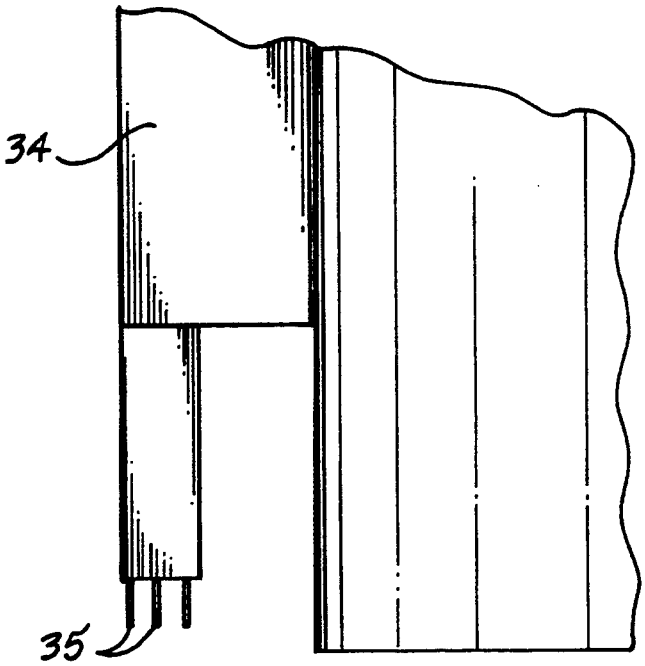
FIG. 8 is an enlarged orthographic view, taken along the lines 8—8 of FIG. 7 in the direction indicated by the arrows.

The FIGS. 7 and 8 indicates the use of a modified cylindrical head **18*a*, having at least one and typically a plurality of ribs 34 projecting radially and exteriorly of the modified sleeve 18*a* such that the ribs 34 insure puncturing and total destruction of the first and second capsules 29 and 30 to further insure the mixing of the epoxy resin and hardener together. Further, a plurality of pin members 35, and typically at least one pin member 35, is mounted to a lowermost end of the rib 34, as indicated, wherein the pin members 35 extend from the rib 34 to a bottom wall of the cylindrical head 18*a***.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A masonry tie, comprising, a first anchor plate, having a central opening to receive mortar therethrough, wherein the first anchor plate includes a base leg and a first leg and a second leg, with the first leg and the second leg extending from the base leg at an apex, with the cylindrical head mounted to the apex, with the cylindrical head orthogonally oriented relative to the first anchor plate, and a second anchor plate, the second anchor plate orthogonally oriented relative to the first anchor plate, and including a mounting plate fixedly and orthogonally mounted at a first end of the second anchor plate, and the second anchor plate including a second anchor plate second end having a tubular sleeve, with the tubular sleeve arranged to receive the cylindrical head therewithin, and the tubular sleeve oriented in a parallel orientation relative to the mounting plate.

2. A masonry tie as set forth in claim 1 wherein the base leg includes a base leg first side and a base leg second side, with a first blade member orthogonally and fixedly mounted to the base leg first side, and a second blade member orthogonally and integrally mounted to the base leg second side.

3. A masonry tie as set forth in claim 2 wherein the tubular sleeve includes a sleeve entrance opening at a first end of the tubular sleeve, and a sleeve floor oriented at a second end of the tubular sleeve, wherein the floor is arranged for abutment with the cylindrical head, wherein the cylindrical head is directed into the tubular sleeve, and the tubular sleeve having a side wall opening diametrically opposed through the tubular sleeve relative to the second anchor plate.

4. A masonry tie as set forth in claim 3 wherein the sleeve defines a sleeve cavity between the sleeve entrance opening and the sleeve floor, wherein the sleeve cavity includes a first channel and a second channel in a facing relationship relative to one another, wherein the first channel and the second channel each include a first capsule and a second capsule, wherein the first capsule includes an epoxy resin and the second capsule includes an epoxy hardener, wherein the epoxy resin and the epoxy hardener are mixed upon projection of the cylindrical head within the tubular sleeve and within the sleeve cavity.

5. A masonry tie as set forth in claim 4 wherein the cylindrical head includes at least one rib member arranged for reception with one of the first channel and the second channel, wherein the rib includes at least one pin member extending from the rib to a lowermost end of the cylindrical head.

* * * * *